US005734314A

United States Patent [19]

Kuo

[11] Patent Number: 5,734,314

[45] Date of Patent: Mar. 31, 1998

[54] LOW RESISTANCE PAINTS FOR SURGE APPLICATIONS USING NICKEL-CHROMIUM ALLOY BLENDED WITH ADDITIONAL ALLOYS

[75] Inventor: Charles C. Y. Kuo, Elkhart, Ind.

[73] Assignee: CTS Corporation, Elkhart, Ind.

[21] Appl. No.: 689,531

[22] Filed: Aug. 8, 1996

[51] Int. Cl.[6] ..... H01C 1/012; H01C 7/10

[52] U.S. Cl. ..... 338/308; 338/22 R

[58] Field of Search ..... 338/20, 21, 22 R, 338/225 D, 23, 24, 95, 308; 252/514, 515; 361/117, 118; 219/494, 505; 75/252, 255

[56] References Cited

U.S. PATENT DOCUMENTS

| | | | |
|---|---|---|---|
| 4,780,598 | 10/1988 | Fahey et al. | 219/511 |
| 4,999,049 | 3/1991 | Balderson et al. | 75/234 |
| 4,999,731 | 3/1991 | Bender et al. | 361/119 |
| 5,057,964 | 10/1991 | Bender et al. | 361/118 |
| 5,064,997 | 11/1991 | Fang et al. | 219/505 |
| 5,166,658 | 11/1992 | Fang et al. | 338/23 |
| 5,345,512 | 9/1994 | Brown | 338/20 |
| 5,518,521 | 5/1996 | Kuo | 75/252 |

*Primary Examiner*—Adolf Berhane

*Attorney, Agent, or Firm*—Albert W. Watkins; Michael W. Starkweather

[57] ABSTRACT

A surge resistor has a thick film resistance element containing alloyed nickel-chromium mixed with alloyed copper-nickel and less than twenty percent by weight glass. The surge resistor overcomes the limitations of the prior art by offering the unexpected advantage of improved power surge handling capacity. A thick film composition used to form the surge resistor, which also includes screening agent, is fired at temperatures generally below 1,000° C., yielding a highly stable and well adhered electrical resistor. In addition to improved surge capability, the composition offers lower cost and less migration than the precious metal alternatives that the composition replaces. Additional inventive surge resistors include copper-manganese and nickel-chromium in combination with less than twenty percent by weight glass.

14 Claims, 1 Drawing Sheet

LOW RESISTANCE PAINTS FOR SURGE APPLICATIONS USING NICKEL-CHROMIUM ALLOY BLENDED WITH ADDITIONAL ALLOYS

BACKGROUND OF THE INVENTION

1. Field of the Invention

This invention pertains to electrically conductive vitreous enamel compositions in general, and particularly to low Temperature Coefficient of Resistance (TCR) composition thick film resistors that are, on occasion, subjected to large surges of electrical energy.

2. Description of the Related Art

Thick film resistors, herein considered to be resistors that have a layer of resistive material deposited upon a non-conductive substrate, are most commonly formed from screen printing techniques. Other processes may be used to form thick film resistors, such as lamination or subtractive processes including etching. For the purposes of this application, thick films are defined as films formed when specially formulated pastes or inks are applied and fired onto a substrate in a definite pattern and sequence to produce a set of individual components, such as resistors and capacitors, or a complete functional circuit. The pastes are usually applied using a screen printing method, and may typically have a thickness of from 0.5 to 1 mil or more. Cermet materials are materials comprising CERamic or glass in combination with METal compositions.

In electrical applications electrical transients occasionally occur upon failure of components, applied voltage surges such as improper connection of a power source, or induced signals from neighboring equipment. Additionally, in some high power applications where power is controlled by switching devices, surges of power may occur during switching that are much larger than normal or average power levels. Transients of sufficient magnitude, regardless of source, can cause failure of resistors including the resistors that form a part of circuitry specifically designed to protect other circuitry from the surge.

A thick film resistor that has failed because of an electrical surge usually has tell-tale signs. Electrically generated thermal energy usually concentrates about one or several localized regions. The localized heating may cause separation of the resistive material from the substrate, cracking of the resistive material, fracture of the substrate material, drift in resistance value, or a melting or fusing of materials. The prior art in U.S. Pat. N 2,910,664 to Lanning, U.S. Pat. No. 3,468,011 to Curtis, U.S. Pat. No. 4,245,210 to Landry et al., and U.S. Pat. No. 4,647,900 to Schelhorn et al. discuss various methods for reducing the ill effects of surges.

Lanning discloses the formation of a particular termination geometry that extends transversely to a resistor element to prevent current crowding from occurring in the resistor material close to the termination. In this disclosure, any design changes influence the performance of a resistor only at the terminations. While in some applications this may be invaluable, there are other applications or resistor configurations where failure occurs generally within the body of the resistor. The Lanning disclosure does not address variations in thickness or voids at the interface between resistor and termination, both which are common in screen printed resistors.

Curtis discloses the separation of a single resistor body into several discrete elements which then divide the current flow. The Curtis design limits current crowding with resistor paths having length very nearly equal to diagonal measure. Additionally, current then divides between many locations to reduce the concentration of heating. However, the Curtis disclosure also requires formation of fine lines as opposed to the formation of a single large block. The minimum size of resistive material that may be patterned without complete loss of conductivity due to the formation of voids, micro-cracks or other defects limits applicability of the Curtis disclosure. Further, while the Curtis disclosure does provide for better thermal distribution than the prior art illustrated by Curtis, there are still many discrete regions (as opposed to one) that may be elevated to harmful or destructive temperatures during a transient surge. In effect, this design does not eliminate the electro-thermal heating at the terminations, but rather divides one "hot spot" into several spots.

Landry et al. disclose the use of multiple layers of high resistance material to reduce current crowding resulting from voids, non-homogeneity, and geometry irregularities such as surface roughness and thickness of deposited films. However, the Landry et al. resistor requires compatible and migration-free materials to prevent resistance drift with environmental cycling. Further, in screen printing applications, the use of multiple layers implies a very thick resistive film that uses excessive material and may be more likely to form cracks during production firing and later during operation. Additionally, Schelhorn et al identified the migration of conductive during multi-step firing as another concern for the Landry et al. design.

Schelhorn et al. disclose the formation of a first relatively conductive resistor material that extends between electrical terminations and a second resistor material of relatively greater resistance applied over the first resistor material. This combination is said to offer many of the advantages of the Landry et al. disclosure without the expense and loss of yield associated with multiple firing processes. Both materials of the Schelhorn et al. disclosure must be present virtually from one terminal to another. This co-extensive application may carry a large materials expense, particularly in those situations that require precious metal materials and sizable resistors. Additionally, the Schelhorn resistor may experience greater resistance drift with environmental cycling if the two resistive materials are not completely compatible and free from migration. In summary, while migration during firing may be reduced in comparison with the Landry et al. disclosure, the large material usage associated with the second high resistance layer and the drawbacks inherent to both the Landry and Schelhorn design makes these approaches less than ideal.

There are additionally other disclosures on the use of resistors that have a positive temperature coefficient (PTC) where the resistance value increases by several orders of magnitude with an increase in temperature. Exemplary of this is U.S. Pat. No. 4,467,310 by Jakab. Also disclosed are various electro-thermal and thermal fuses that act to form a discontinuity in the event of a surge of power. Exemplary of this is U.S. Pat. No. 4,494,104 to Holmes. These PTC devices and fuses are used together with the thick film resistor or other component, wherein a surge activates the PTC device or fuse and thereby protects the thick film resistor or other circuit component. However, PTC devices and electrothermal and thermal fuses require a finite amount of time for the mass of the device to reach a temperature sufficient to activate the device. During this finite period, thick film compositions and other components may be adversely affected. Further, the use of a separate protective component to prevent failure of each device is not desirable in view of the increased cost that would necessarily be associated therewith. In summary, the prior art is limited to particular geometries or configurations that tend to be costly and do not have the performance features most desirable.

In recent years, low sheet resistance and low TCR thick film resistors for use in high power and lightning surge protection applications have been in greater demand. These special resistors should have a sheet resistance from ¼ to a few ohms per square with a TCR less than ±100 ppm/° C. The characteristics and performance of these resistors should be comparable to those of the best ruthenium-based resistors, and they may be patterned to form very tight spirals.

TCR stands for Temperature Coefficient of Resistance, which is a measure of the amount of change in resistance over some temperature range. For the purposes of the remainder of this disclosure, TCR may be further divided into cold TCR (CTCR) and hot TCR (HTCR). Cold TCR is measured over the temperature range from −55 to +25 degrees Centigrade, while hot TCR is measured from +25 to +125 degrees Centigrade.

Sheet resistivity for the purposes of this disclosure is measured in the units of ohms per square. This will be considered herein to be the resistance of a 1 mil thick film of equal length and width.

Resistors made from palladium-silver compositions have been used for low sheet resistance and low TCR applications. However, the cost of precious metals, especially with a high percentage of palladium, is much higher than the cost of base metals. In addition, the palladium-silver circuits may be plagued by silver migration problems.

Nichrome has been produced in wire form for heating elements for more than a century. The nickel chromium alloy is very stable, as demonstrated by the long durations of operation at very elevated temperature. In fact, nickel chromium alloys are the lowest cost and most commonly used heating alloys for temperatures up to approximately 1,000° C. Wirewound resistors have been similarly formed from Nichrome, to attempt to take advantage of these beneficial characteristics. However, these wire resistors exhibit inductance problems and are of large size, thereby limiting application.

Nichrome thin films formed by vacuum deposition have been used in thin film circuits for many years. The thick film approach is easier and more cost effective than thin film, thus limiting the use of thin film to special applications.

Thick film ink, using pre-alloyed nickel chromium powder for example, can meet many of the specifications required for general purpose resistor applications at relatively low cost. Nickelchromium and copper-nickel have each been used individually as general purpose resistors in the prior art, as, for example, disclosed by Howell in U.S. Pat. No. 3,794,518 and Merz et al in U.S. Pat. No. 4,060,663. However, these prior art base metal materials are inadequate to cover the required resistance ranges and still provide the capability for handling large surges of electrical power.

SUMMARY OF THE INVENTION

A thick film surge resistor contains alloyed nickel-chromium with a low TCR mixed with alloyed copper-nickel, also with a low TCR, and further mixed with less than twenty percent by weight glass. Additional inventive surge resistors include copper-manganese and nickel-chromium in combination with less than twenty percent by weight glass. The surge resistors may be formed into serpentine and spiral patterns and will withstand short term overload testing.

OBJECTS OF THE INVENTION

An object of the present invention is to overcome the need for forming multiple thick film layers upon a substrate in order to meet stringent surge requirements.

An additional object of the invention is to replace precious metal materials with much less expensive base metal materials. A further object is to maintain or exceed the performance obtained with precious metal materials.

A further object of the invention is to achieve a compact, low cost base metal surge resistor of low resistivity and high electrical strength. These and other objects of the invention are achieved in the preferred embodiment, which is best understood when considered in conjunction with the following drawing figure.

DESCRIPTION OF THE PREFERRED EMBODIMENT

Figure 1:
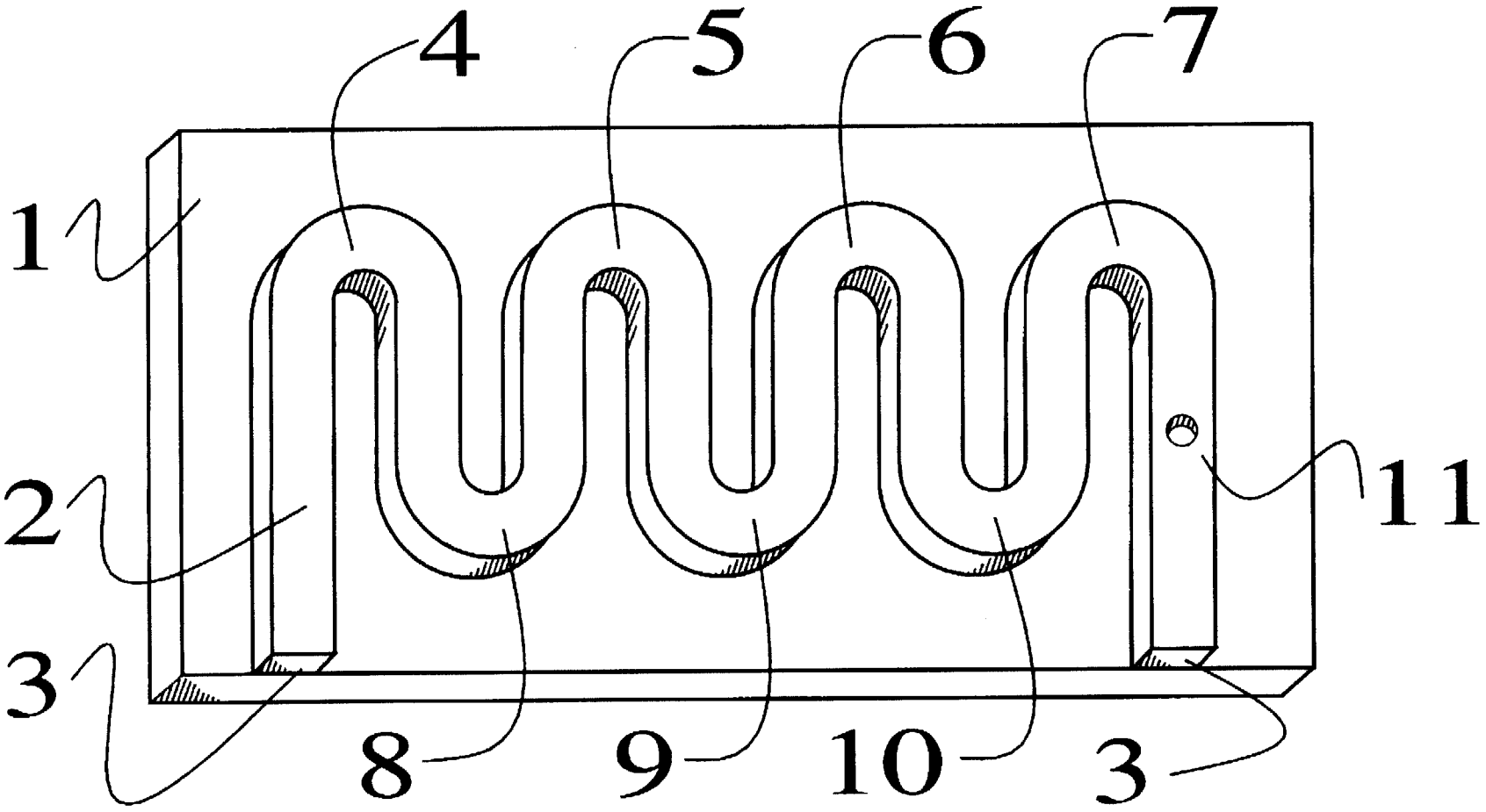
FIG. 1 illustrates a surge resistor in accord with the present invention formed upon a substrate.

A substrate 1 shown in FIG. 1 is typically fashioned from a non-conductive material such as alumina. Upon this substrate a resistor 2 is patterned to form a film type resistor. The resistor 2 in FIG. 1 has a serpentine pattern, although other patterns, such as block resistors or spiral designs, might be applied by one of ordinary skill familiar with resistors. This particular serpentine has curves formed in the conductive pattern 2 designated by the numerals 4–10. The resistor additionally has terminations designated by the numeral 3. Power is generally applied through the terminations 3, resulting in a flow of current through resistor 2. At each curve 4–10, current flow usually concentrates at the inside part of the curve, taking the shortest path around the curves. Additionally, imperfections in the film result in narrow regions such as region 11 having less conductive for a given amount of current to flow through. Since according to Ohm's law power dissipation is equal to the amount of current flow divided by resistance, power dissipation is localized toward the inside of each of the curves 4–10 and at each imperfect region 11. During the application of a large surge of power, such as might be applied during a lightning strike, the heating of the resistor material at these curves and imperfections is sometimes sufficient to cause destructive failure. An uncontrolled failure of the resistor is undesirable and ways have been sought to resolve this problem.

The present invention reduces failures through the selection of materials for this surge application. During comparative testing, it was unexpectedly discovered that the use of particular base metal cermet compositions, having features otherwise very similar to noble metal palladium-silver cermet compositions, survived greater applications of energy than the noble metal counterparts. The mechanism for this difference is not explained by the features described on the product specification sheets, as materials of comparable resistance values were compared. However, results support significantly greater surge power handling capacity. The compositions of the present invention each contain less than twenty percent by weight glass, and this was determined to be critical to the success of the invention in surge applications. Where the compositions were allowed to go above twenty percent by weight glass, the devices failed surge testing.

The limitation on the amount of glass in the composition proved most challenging, since the glass composition is usually varied to control the sheet resistivity of the device. The Merz prior art nickel-chromium compositions range between twenty and seventy-eight percent glass, while the Howell prior art copper-nickel compositions range between twenty-five and seventy-five percent glass.

The presently preferred compositions are based upon a copper-nickel alloy blended with a nickel-chromium alloy, glass, and appropriate screening agents as available commercially. The resulting composition is then screen printed upon a substrate in a desired geometry and fired in a nitrogen atmosphere to yield a surge resistor made in accord with the preferred embodiment. Additional protective covercoats of glass or polymer dielectric may be added as desired and known in the art. In comparative testing, resistors formulated from the copper-nickel and nickel-chromium composition were found to survive surges of power that resulted in destruction of comparably produced palladium-silver compositions. Furthermore, the blended compositions were able to be formulated to continuously cover the range from 0.2 to 2 ohms per square, enabling much greater latitude in designing suitable surge resistors for a given application.

Other novel compositions are formed from the blending of copper-manganese alloy with nickel-chromium alloy, together with less than twenty percent by weight glass and additional appropriate screening agent. It is important to note that the glass must be below twenty percent by weight in the fired film, which discounts any weight which might otherwise be considered to be contributed by the screening vehicle.

The application of the blended alloy formulations to surge resistors accomplishes several benefits that the prior art does not teach. The complete termination of resistors such as Lanning and Curtis illustrate does not overcome current crowding that originates with the presence of voids in the resistive compositions. The effects of these voids are difficult to eliminate, other than by the formation of multiple layers illustrated by Landry et al., yet the voids are a significant source of failure in many film components. By using a composition such as disclosed in the preferred embodiment, any voids present will not be as significant to the performance of the finished resistor.

While others including Schelhorn teach the use of multiple layers, these layers extend from one termination to another and do not address localized current crowding. The use of layers from one termination to the other wastes valuable and often very expensive conductive composition, and, in those instances where there is significant current crowding, will not overcome component failure upon exposure to surge. The use of a composition better able to survive large surges of power addresses both current crowding and defects in the film structure.

The following examples illustrate specific embodiments of the invention and comparative examples with the prior art. For the purposes of this disclosure, Short Term Over Load (STOL) is defined as a test where large short term pulses of electrical energy are applied to a resistor. In order for the resistor to pass the STOL test, the resistor must change in resistance by less than one-half of one percent.

COMPARATIVE EXAMPLE 1

A spiral surge resistor pattern was designed which required narrow serpentine traces of resistor material having sheet resistivity of 0.5 ohms/square. A copper-nickel alloy with low intrinsic TCR of less than 200 ppm/degree centigrade was blended with twenty percent glass and fired, but failed to meet the required resistivity with a sheet resistivity of less than 0.2 ohms/square.

COMPARATIVE EXAMPLE 2

The same spiral serpentine surge resistor of comparative example 1 was formed, and this time sufficient glass (greater than twenty percent by weight) was added to the composition to bring the sheet resistivity to 1 ohm/square. The surge resistor failed the STOL test.

COMPARATIVE EXAMPLE 3

A copper-manganese alloy with low intrinsic TCR of less than 200 ppm/degree centigrade was blended with glass and screening agent and then patterned to form the same spiral serpentine pattern of comparative example 1. Sufficient glass (greater than twenty percent) was included to raise the sheet resistivity of the surge resistor to 1 ohm/square. The resultant surge resistor failed the STOL test.

COMPARATIVE EXAMPLE 4

A nickel-chromium alloy with low intrinsic TCR of less than 200 ppm/degree centigrade was blended with less than twenty percent glass and screening agent. The composition was then patterned to form the spiral serpentine pattern of comparative example 1. The resultant resistor failed the resistivity requirement at one ohm/square resistivity.

EXAMPLE 5

A copper-nickel alloy with low intrinsic TCR of less than 200 ppm/degree centigrade was blended in a 80:20 ratio with a nickel-chromium alloy with low intrinsic TCR of less than 200 ppm/degree centigrade. The mixture was then blended with less than twenty percent glass and an appropriate screening agent. The resulting composition was patterned and fired at 760 degrees centigrade to form a spiral serpentine surge resistor as in comparative example 1. The resistor passed the STOL test and had an acceptable sheet resistivity of 0.53 ohms/square. The hot and cold TCR were both less than 200 ppm.

EXAMPLE 6

A copper-nickel alloy with low intrinsic TCR of less than 200 ppm/degree centigrade was blended in a 80:20 ratio with a nickel-chromium alloy with low intrinsic TCR of less than 200 ppm/degree centigrade. The mixture was then blended with less than twenty percent glass and an appropriate screening agent. The resulting composition was patterned and fired at 815 degrees centigrade to form a spiral serpentine surge resistor as in comparative example 1. The resistor passed the STOL test and had an acceptable sheet resistivity of 0.4 ohms/square. The hot and cold TCR were both less than 200 ppm/degree centigrade.

EXAMPLE 7

A copper-nickel alloy with low intrinsic TCR of less than 200 ppm/degree centigrade was blended in a 80:20 ratio with a nickel-chromium alloy with low intrinsic TCR of less than 200 ppm/degree centigrade. The mixture was then blended with less than twenty percent glass and an appropriate screening agent. The resulting composition was patterned and fired at 890 degrees centigrade to form a spiral serpentine surge resistor as in comparative example 1. The resistor passed the STOL test and had an sheet resistivity of 0.35 ohms/square. The hot and cold TCR were both less than 200 ppm/degree centigrade.

EXAMPLE 8

A copper-nickel alloy with low intrinsic TCR of less than 200 ppm/degree centigrade was blended in a 40:60 ratio with a nickel-chromium alloy with low intrinsic TCR of less than 200 ppm/degree centigrade. The mixture was then blended with less than twenty percent glass and an appropriate screening agent. The resulting composition was patterned and fired at 890 degrees centigrade to form a spiral serpentine surge resistor as in comparative example 1. The resistor passed the STOL test and had an acceptable sheet resistivity of 0.60 ohms/square. The hot and cold TCR were both less than 200 ppm/degree centigrade.

Additional surge resistor examples were prepared at blending ratios for copper-nickel to nickel-chromium of from 10:90 to 90:10, and with glass levels of less than twenty percent by weight of the fired film. The hot and cold TCR remained at less than 200 ppm/degree centigrade, and the resistors passed the STOL test. Sheet resistivity varied form 0.16 ohms/square at firing temperatures of 890 degrees centigrade and 10:90 ratios to 2 ohms/square at 90:10 ratio with 760 degree centigrade firing.

While the foregoing details what is felt to be the preferred embodiment of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

I claim:

1. A surge resistor comprising a thick film resistance material composed of between 10 and 90 parts alloyed nickel-chromium having a cold TCR of less than 200 parts per million per degree centigrade and having a hot TCR of less than 200 parts per million per degree centigrade, between 90 and 10 parts alloyed copper-nickel having a cold TCR of less than 200 parts per million per degree centigrade and having a hot TCR of less than 200 parts per million per degree centigrade, and less than twenty percent by weight glass.

2. The surge resistor of claim 1 further comprising a substrate, first and second terminations and a serpentine pattern upon said substrate between said first and second terminations.

3. The surge resistor of claim 1 further comprising a substrate, first and second terminations and a spiral pattern upon said substrate between said first and second terminations.

4. The surge resistor of claim 2 wherein said thick film resistance material has a sheet resistivity of between 0.2 and 2 ohms/square.

5. The surge resistor of claim 2 wherein said thick film resistance material has a sheet resistivity of 0.5 ohms/square.

6. The surge resistor of claim 3 wherein said thick film resistance material has a sheet resistivity of between 0.2 and 2 ohms/square.

7. The surge resistor of claim 3 wherein said thick film resistance material has a sheet resistivity of 0.5 ohms/square.

8. A surge resistor comprising a thick film resistance material composed of between 10 and 90 parts alloyed nickel-chromium having a cold TCR of less than 200 parts per million per degree centigrade and having a hot TCR of less than 200 parts per million per degree centigrade, between 90 and 10 parts alloyed copper-manganese having a cold TCR of less than 200 parts per million per degree centigrade and having a hot TCR of less than 200 parts per million per degree centigrade, and less than twenty percent by weight glass.

9. The surge resistor of claim 8 further comprising a substrate, first and second terminations and a serpentine pattern upon said substrate between said first and second terminations.

10. The surge resistor of claim 8 further comprising a substrate, first and second terminations and a spiral pattern upon said substrate between said first and second terminations.

11. The surge resistor of claim 9 wherein said thick film resistance material has a sheet resistivity of between 0.2 and 2 ohms/square.

12. The surge resistor of claim 9 wherein said thick film resistance material has a sheet resistivity of 0.5 ohms/square.

13. The surge resistor of claim 10 wherein said thick film resistance material has a sheet resistivity of between 0.2 and 2 ohms/square.

14. The surge resistor of claim 10 wherein said thick film resistance material has a sheet resistivity of 0.5 ohms/square.

* * * * *